US008698115B1

(12) United States Patent
Onishi et al.

(10) Patent No.: US 8,698,115 B1
(45) Date of Patent: Apr. 15, 2014

(54) LIGHT SOURCE DEVICE AND METHOD FOR GENERATING EXTREME ULTRAVIOLET LIGHT

(71) Applicant: A School Corporation Kansai University, Suita (JP)

(72) Inventors: Masashi Onishi, Osaka (JP); Waheed Hugrass, Launceston (AU)

(73) Assignee: A School Corporation Kansai University, Osaka (JP)

( * ) Notice: Subject to any disclaimer, the term of this patent is extended or adjusted under 35 U.S.C. 154(b) by 0 days.

(21) Appl. No.: 13/851,349

(22) Filed: Mar. 27, 2013

(51) Int. Cl.
*H05G 2/00* (2006.01)

(52) U.S. Cl.
USPC ..... 250/504 R; 313/567; 313/637; 313/641; 313/643

(58) Field of Classification Search
USPC ..... 250/504 R; 313/567, 637, 641, 643; 378/121
See application file for complete search history.

(56) References Cited

U.S. PATENT DOCUMENTS

2002/0168049 A1* 11/2002 Schriever et al. ..... 378/119

FOREIGN PATENT DOCUMENTS

JP 2008-130230 A 6/2008

* cited by examiner

*Primary Examiner* — Michael Maskell
(74) *Attorney, Agent, or Firm* — Carrier Blackman & Associates, P.C.; Joseph P. Carrier; William D. Blackman

(57) ABSTRACT

A light source device repeatedly implements a first state and a second state in alternate shifts. The energy of a standing wave generated in a cavity resonator is absorbed by a rare gas or the like existing in a hollow member. This implements the first state in which plasma is generated and the electron temperature thereof is increased, and then the extreme ultraviolet light emitted from the plasma is emitted out of the cavity resonator through a window. The supply of the electromagnetic wave to the cavity resonator is interrupted. This implements the second state in which the plasma is extinguished.

11 Claims, 3 Drawing Sheets

LIGHT SOURCE DEVICE AND METHOD FOR GENERATING EXTREME ULTRAVIOLET LIGHT

BACKGROUND OF THE INVENTION

1. Field of the Invention

The present invention relates to a technique for generating extreme ultraviolet light used, for example, to form a circuit pattern on a semiconductor wafer.

2. Description of the Related Art

As a method for fabricating semiconductor integrated circuits adopted as the storage elements, information processing elements and the like for a variety of electrical equipment, such as personal computers, mobile phones and navigation systems, there has been known lithography whereby to irradiate light to a mask with a circuit pattern formed thereon so as to transfer the circuit pattern of the mask onto a photosensitive resin, namely, photoresist, on a semiconductor wafer.

Currently, the g-ray of a high-pressure mercury lamp having a wavelength of 436 nm, the i-ray having a wavelength of 365 nm, a KrF excimer laser having a wavelength of 248 nm, and an ArF excimer laser having a wavelength of 193 nm are mainly used for the wavelengths of the light used with the lithography. Longer wavelengths of light tend to lead to lower resolutions of circuit patterns on photoresists, thus making it impossible to achieve a higher level of integration of semiconductors, i.e., miniaturized circuit patterns, with the light of the aforesaid wavelengths. As a solution, there have been provided a laser-produced plasma (LPP) light source and a discharge-produced plasma (DPP) light source adapted to generate extreme ultraviolet light (hereinafter referred to as the EUV light, as appropriate), which has still shorter wavelengths (refer to Japanese Patent Application Laid-Open No. 2008-130230).

The EUV light has a characteristic of being absorbed by glass, thus making it impossible to make, for example, a change of the path of light by a glass optical system, such as a lens. For this reason, a Mo/Si multilayer film, the reflectance of which reaches the peak at a short wavelength, namely, a 13.5-nm wavelength, is employed as the optical system, i.e., the reflecting mirror, to change the path of light.

Therefore, both the laser-produced plasma light source and the discharge-produced plasma light source are configured to be capable of producing light having a wavelength suited for the characteristics of the optical system (the light having a wavelength of 13.5 nm that minimizes a reflection loss in the optical system). To be more specific, the laser-produced plasma light source is configured to irradiate a powerful laser, namely, a YAG laser, to tin (Sn) or tin (Sn) compound, which is a target material, thereby to produce plasma light exhibiting an intense emission peak in the vicinity of 13.5 nm. The discharge-produced plasma light source is configured to pass and discharge a high electrical current of a steady frequency between a pair of electrodes thereby to generate plasma light, which includes a light component having a wavelength of 13.5 nm, between the electrodes.

According to the light sources, however, the generation of the plasma produces debris, i.e., impurities, which interfere with the transfer of a circuit pattern onto a semiconductor wafer. More specifically, in the laser-produced plasma light source, debris is produced from a target material, namely, the tin, which is solid at ordinary temperature, as plasma is generated. In the discharge-produced plasma light source, debris is produced from the electrodes as plasma is produced, so that the debris adheres to an optical system, a mask or a semiconductor wafer, interfering with the transfer of a circuit pattern onto a semiconductor wafer.

SUMMARY OF THE INVENTION

Accordingly, an object of the present invention is to provide a light source device and method that make it possible to produce light having an appropriate wavelength for forming a highly integrated circuit on a semiconductor wafer without generating debris.

A light source device in accordance with the present invention comprises: a cavity resonator having a window; a hollow member which is formed of an electrically isolating, nonmagnetic material, and which is disposed in an internal space of the cavity resonator; and an electromagnetic wave supply unit configured to form a standing wave by supplying an electromagnetic wave to the internal space of the cavity resonator, wherein the light source device is configured to repeat, in alternate shifts, a first state in which the electromagnetic wave supply unit supplies an electromagnetic wave to the internal space of the cavity resonator to cause a rare gas or a mixed gas containing a rare gas, which exists in the hollow member, to absorb the energy of the standing wave thereby to generate plasma and to raise an electron temperature thereof so as to emit extreme ultraviolet light, which is emitted from the plasma, out of the cavity resonator through the window, and a second state in which the electromagnetic wave supply unit stops the supply of the electromagnetic wave to the internal space of the cavity resonator thereby to extinguish the plasma.

DESCRIPTION OF THE PREFERRED EMBODIMENTS (Configuration)

Figure 1:
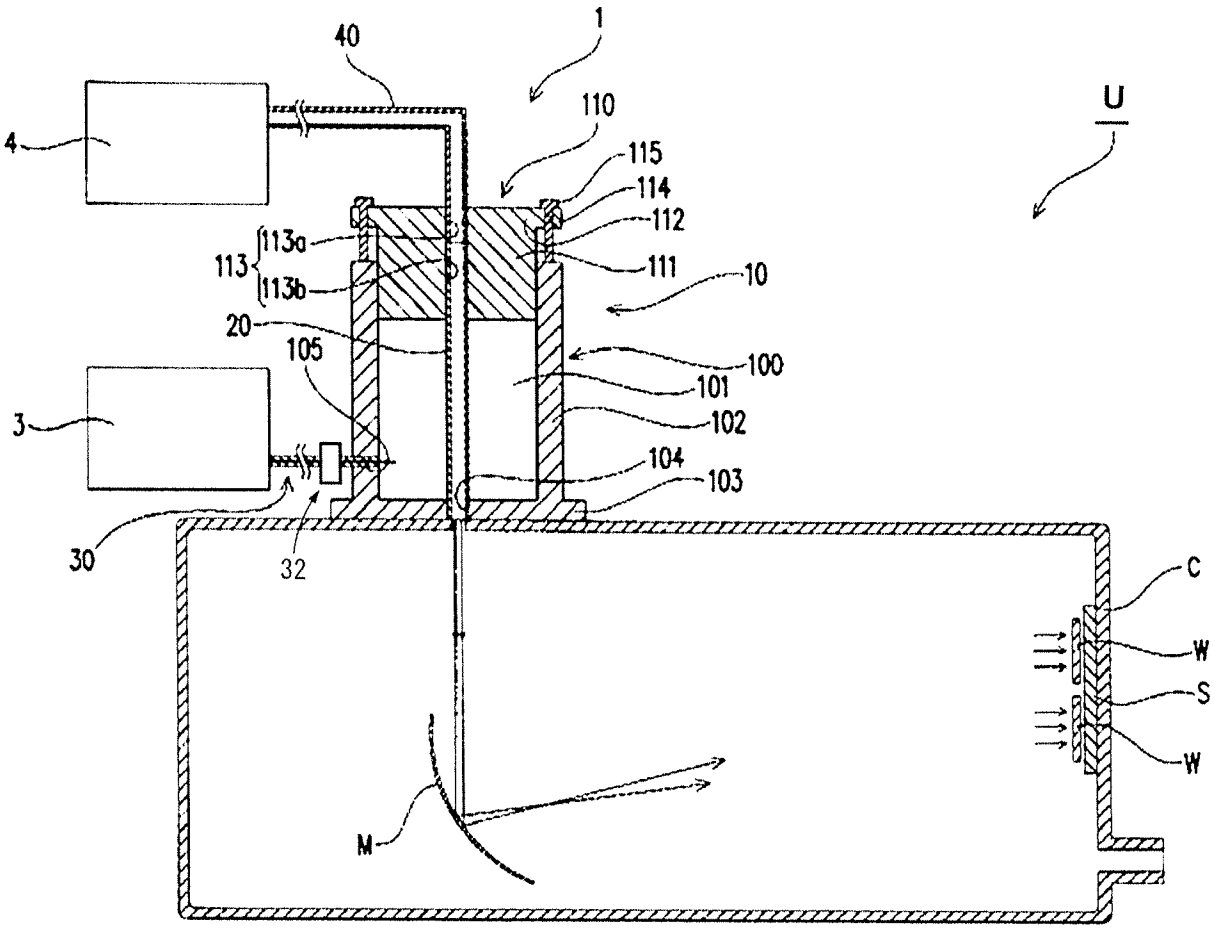
FIG. 1 is a schematic configuration diagram of a semiconductor lithography apparatus including a semiconductor lithography light source device according to an embodiment of the present invention.

A light source device 1, which is an embodiment of the present invention illustrated in FIG. 1, is a semiconductor lithography light source device configured to generate extreme ultraviolet light for forming a circuit pattern on a semiconductor wafer W.

The light source device 1 is incorporated in a semiconductor lithography device U as a constituent element thereof, the semiconductor lithography device U being adapted to transfer a circuit pattern onto the semiconductor wafer W. To be more specific, the semiconductor lithography device U has the light source device 1, a stage S on which the semiconductor wafer W is disposed, a mask (not shown) on which a circuit pattern to be transferred onto the semiconductor wafer W on the stage S has been formed, and an optical system M which leads the light from the light source device 1 to the mask.

In the semiconductor lithography device U, the stage S, the mask and the optical system M are installed in a hermetically sealed casing C, and the light source device 1 is consecutively installed to the outer surface of the casing C. In the semiconductor lithography device U, a rotary pump and a turbomolecular pump (not shown) for vacuumizing the space inside the casing C are connected to the casing C.

The light source device 1 includes a cavity resonator 10 having an internal space 101 formed therein, a hollow member 20 which is formed of an electrically isolating, nonmagnetic material and which is filled therein with a rare gas or a mixed gas containing a rare gas, and an electromagnetic wave supply unit 3 for supplying electromagnetic waves to the internal space 101 of the cavity resonator 10. The hollow member 20 is configured to permit the emission of EUV light and disposed at least partly in the internal space 101 of the cavity resonator 10. Further, the cavity resonator 10 has a window or a light emitting section 104 that allows the EUV light emitted from the hollow member 20 to be emitted outside. The light source device 1 includes a gas supply unit 4 for supplying a rare gas or a mixed gas containing a rare gas to the hollow member 20.

Figure 2:
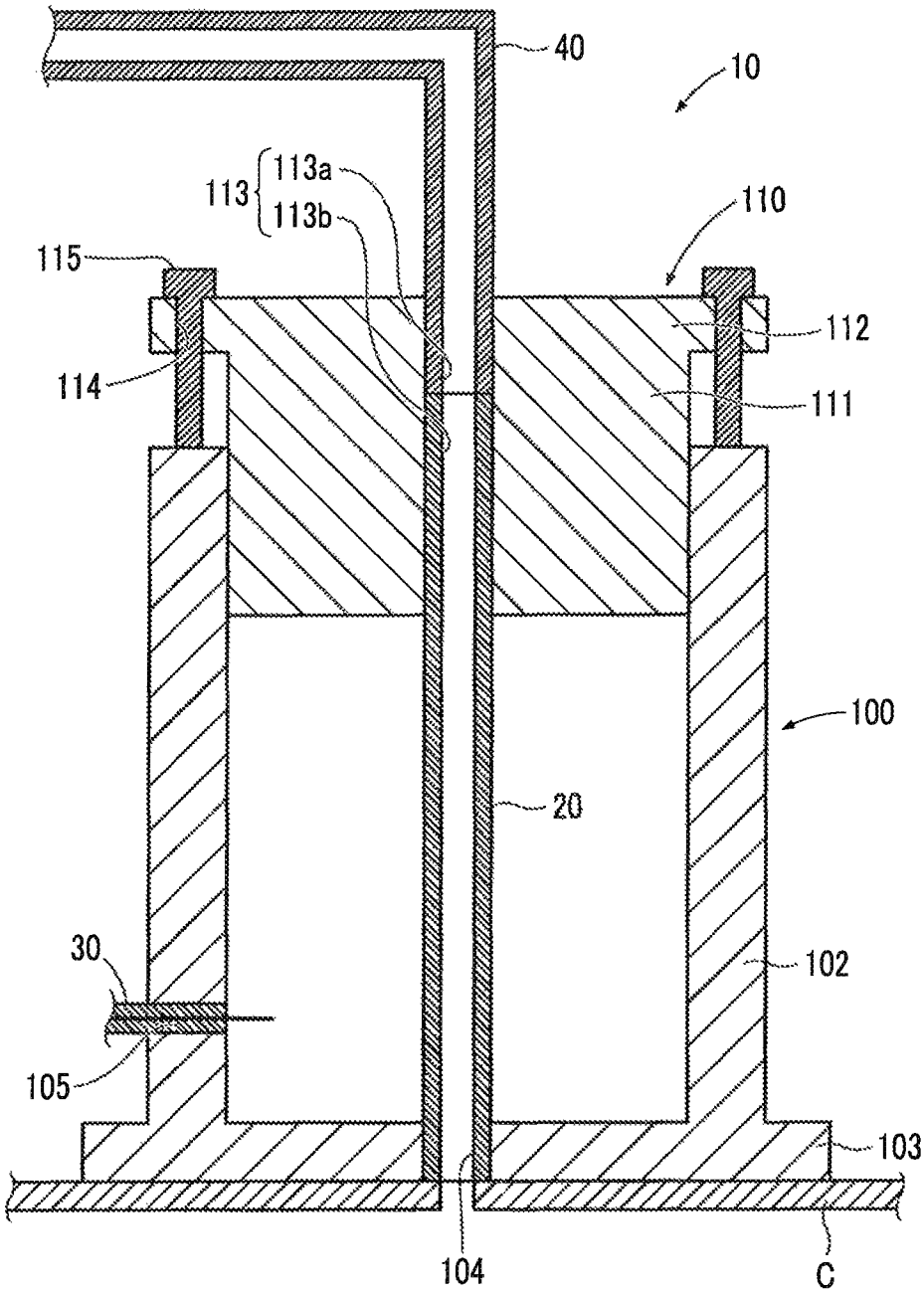
FIG. 2 is a schematic configuration diagram of the semiconductor lithography light source device according to the embodiment of the present invention.

The cavity resonator 10 is formed of a metal material having high electrical conductivity, such as oxygen-free copper exhibiting a low electrical resistance value. Further, the cavity resonator 10 includes a resonator main body 100 in which a space expanding from the upper end to the lower end, the upper end being open, and a covering member 110 that closes the upper end of the resonator main body 100, as illustrated in FIG. 2.

The resonator main body 100 is constructed of a peripheral wall section 102 having a cylindrical shape and a bottom section 103, which closes the opening of one end of the peripheral wall section 102. Further, in the resonator main body 100, the inside diameter of the peripheral wall section 102 is set according to a lowest-order resonance mode of an electromagnetic wave. More specifically, TM010 mode is adopted as the lowest-order resonance mode of the electromagnetic wave, so that the inside diameter of the peripheral wall section 102 has been set to 6 cm.

The resonator main body 100 has the light emitting section 104 (or the window), which allows the EUV light emitted by the plasma of a rare gas generated in the hollow member 20 to be emitted from the internal space 101 to the outside, i.e., the inside of the casing C. The light emitting section 104 is constituted of a through hole provided at the center of the bottom section 103. The light source device 1 is consecutively provided on the casing C, allowing the light emitting section 104 to emit light toward the casing C. The resonator main body 100 has a connection hole 105 formed in the peripheral wall section 102 for inserting therethrough an output antenna 30, which will be discussed hereinafter.

The covering member 110 has a closing section 111, which is fitted at the upper end of the resonator main body 100 to close the upper end opening, and a flange 112 extending outward in the diametrical direction from the upper end of the closing section 111.

The closing section 111 has a columnar shape, the outside diameter of which is set to have substantially the same size as the inside diameter of the resonator main body 100. With this arrangement, the closing section 111 of the cavity resonator 10 closes the upper end opening of the resonator main body 100 without any gaps.

The portion of the flange 112 that projects from the closing section 111 has a plurality of tapped holes 114 into which male screws 115 can be screwed. The male screws 115 are configured such that the distal ends thereof come in contact with the upper surface of the resonator main body 100 in the state wherein the male screws 115 have been screwed into the tapped holes 114. It is acceptable that the male screw 115 and the tapped holes 114 are abbreviated, and a male screw is provided at an outer surface of the closing section 111 and a female screw is provided at an inner surface of an upper portion of the resonator main body 100, and the height of the internal space 101 is adjusted by rotating the closing section 111 with respect to the resonator main body 100.

The covering member 110 has a through hole 113 passing the central axis thereof. The upper end of the through hole 113 constitutes a pipe insertion hole 113*a* which allows a pipe 40, which will be discussed later, to be inserted therein, while the lower end thereof constitutes a hollow member insertion hole 113*b* in which the hollow member 20 can be inserted.

The covering member 110 is configured to be movable in the vertical direction or the direction of the axis of the internal space 101 in the state wherein the closing section 111 has been fitted to the upper end opening of the resonator main body 100. This allows the cavity resonator 10 to adjust the height of the internal space 101, i.e., a Q value, while securely closing the upper end of the resonator main body 100.

The hollow member 20 is formed of an electrically isolating, nonmagnetic material and disposed at least partly in the internal space 101 of the cavity resonator 10. For example, the hollow member 20 is made of heat-resistant glass (silica glass), ceramics or sapphire.

At least a part of the hollow member 20 is disposed at a position where the electric field amplitude of a standing wave is maximum in the internal space 101 of the cavity resonator 10. To be more specific, the internal space 101 of the cavity resonator 10 is shaped to be columnar, and the hollow member 20 is formed of a tubular member that extends along the central axis of the internal space 101 of the cavity resonator 10 (the location where the electric field intensity of the standing wave of the TM010 mode is maximum). This permits improved efficiency of the absorption of the standing wave energy in the internal space 101 of the cavity resonator 10 by a rare gas or the like or plasma existing in the hollow member 20.

The hollow member 20 is constituted of a cylindrical member with both ends thereof open. The inside diameter of the hollow member 20 is designed to be approximately 1 to 3 mm. The hollow member 20 is disposed such that at least a part thereof is positioned in the internal space 101 of the cavity resonator 10 in the state wherein the hollow member 20 has been inserted in the light emitting section 104 and the bottom end of the through hole 113, i.e., the hollow member insertion hole 113*b*. The hollow member 20 extends in the axial direction of the internal space 101 of the substantially columnar cavity resonator 10.

A magnetron is used as the electromagnetic wave supply unit 3. The electromagnetic wave supply unit 3 is connected to the cavity resonator 10 by the output antenna 105. A waveguide 30 used as the output antenna 105, one end of which is connected to the electromagnetic wave supply unit 3, while the other end of which is inserted in a connection hole provided in the cavity resonator 10.

The gas supply unit 4 is connected to the hollow member 20 through the pipe 40. More specifically, the pipe 40 is inserted in the upper end of the through hole 113, namely, a pipe insertion hole 113*a*, which penetrates from the upper end to the lower end of the covering member 110. One end portion of the hollow member 20 is inserted in the lower end of the through hole 113, namely, the hollow member insertion hole 113*b*, thus enabling the gas supply unit 4 to charge or circulate a rare gas or a mixed gas containing a rare gas into the hollow member 20 from one end of the hollow member 20.

The optical system M is constituted of an Mo/Si multilayer film M. The Mo/Si multilayer film M is formed in a curved shape like a concave mirror. The optical system M is disposed such that the reflecting surface thereof is matched to the optical axis of the light source device 1 so as to be capable of irradiating the EUV light to the semiconductor wafer W on the stage S placed on a line that is substantially parallel to the optical axis. The stage S and the mask have general configurations, so that detailed descriptions thereof will be omitted.

(Functions)

The functions of the light source device 1 constituting the semiconductor lithography device U, i.e., the operation for emitting the EUV light, will be described. First, the Q value, which provides the reference for tuning the cavity resonator 10, and the tuning method will be described.

(Q Value)

The light source device 1 is configured to permit an adjustment for maximizing the Q value associated with standing wave energy $E_Q$ that can be stored in the internal space 101 of the cavity resonator 10. The Q value is described according to expression (1) on the basis of energy $E_M$ of an electromagnetic wave supplied to the cavity resonator 10 and the energy $E_Q$ of the standing wave generated in the cavity resonator 10.

$$Q=2\pi E_Q/E_M \quad (1)$$

In the case where an electromagnetic wave of $E_M$=1 KW is supplied to the cavity resonator 10 having the Q value of 10000, the energy $E_Q$ of the electromagnetic field in the cavity resonator 10 is estimated to be 1.6 MW according to expression (1).

(Tuning)

The energy of the electromagnetic field (standing wave) generated in the cavity resonator 10 is increased or maximized by tuning the cavity resonator 10 (by adjusting the Q value). To be more specific, the covering member 110 (the movable wall section) is moved in the direction of the central line of the cavity resonator 10 by hand or by using an automatic driving mechanism to adjust the height of the internal space 101 and the Q value of the cavity resonator 10 is adjusted by a stub tuner 32 installed before the incident position of a microwave into the cavity resonator 10.

The adjustment of the Q value makes it possible, in the internal space 101 of the cavity resonator 10, to cause the electromagnetic wave supplied by the electromagnetic wave supply unit 3 and the reflected wave produced by the electromagnetic wave being reflected against an inner surface, which defines the internal space 101, to overlap and resonate. Thus, in the internal space 101, it is possible to generate a standing wave, the amplitude, i.e., the energy, of which has been increased by the magnitude based on the Q value with respect to the electromagnetic wave supplied to the internal space 101.

(Light Emitting Operation)

A rare gas or a mixed gas containing a rare gas is charged into the hollow member 20. The internal pressure of the hollow member 20 is controlled to be 1 to 1000 Pa in a state wherein the hollow member 20 has been filled therein with the Xe gas.

The electromagnetic wave generated by the electromagnetic wave supply unit 3 is supplied to the internal space 101 of the cavity resonator 10. In the present embodiment, a microwave of 2.45 GHz, which belongs to the S band, is supplied as the electromagnetic wave to the internal space 101 of the cavity resonator 10. The electromagnetic wave supplied to the internal space 101 of the cavity resonator 10 and the reflected wave of the electromagnetic wave, which has been reflected by the wall section defining the internal space 101, overlap and resonate. As a result, a standing wave, i.e., an electromagnetic field, is generated in the internal space 101.

The light source device 1 is configured to cause the energy of the standing wave generated in the internal space 101 to reach a value based on the Q value of the cavity resonator 10 in an extremely short time until plasma is generated by the Xe gas absorbing the energy of the standing wave.

For example, if the Q value is 10000, then the energy of the standing wave generated in the internal space 101 will be 1.6 MW by supplying an electromagnetic wave having energy of 1000 W to the internal space 101 of the cavity resonator 10 (refer to expression (1)).

This arrangement allows the Xe gas that exists in the hollow member 20 to absorb, from the standing wave, the energy required to generate plasma having an electron temperature in a predetermined electron temperature range (e.g., 20 to 50 eV) that permits the emission of the EUV light.

Figure 3A:
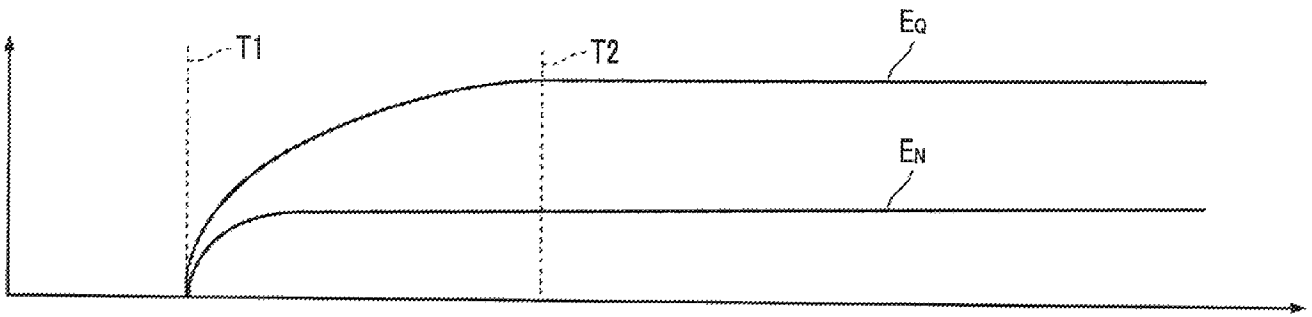
FIG. 3A illustrates the transition of each energy in the case where the semiconductor lithography light source device is operated when the interior of a hollow member is in a vacuum state.

FIG. 3A conceptually illustrates the temporal change modes of the energy $E_M$ of the electromagnetic wave supplied by the electromagnetic wave supply unit 3 to the cavity resonator 10 and the energy $E_Q$ of the standing wave formed in the cavity resonator 10 by the electromagnetic wave in the case where the hollow member 20 has been vacuumized After the supply of the electromagnetic wave to the internal space 101 of the cavity resonator 10 is started by the electromagnetic wave supply unit 3 at time T1, the standing wave energy $E_Q$ gradually increases until it reaches a predetermined value at time T2, then the standing wave energy $E_Q$ is stabilized at the predetermined value.

Figure 3B:
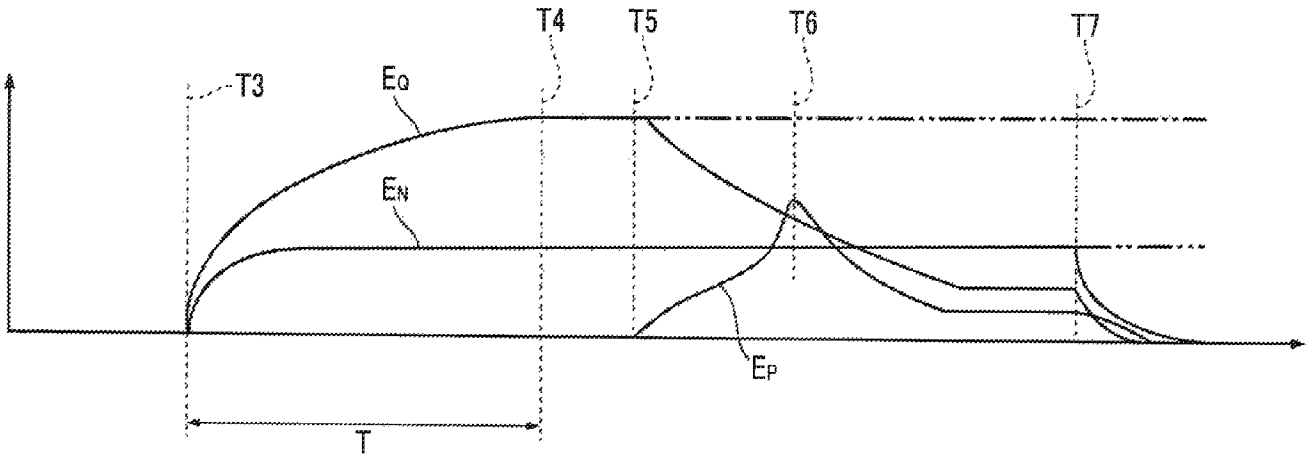
FIG. 3B illustrates the transition of each energy in the case where the semiconductor lithography light source device is operated when the interior of the hollow member has been filled with an Xe gas.

FIG. 3B conceptually illustrates the temporal change modes of $E_M$, $E_Q$ and an energy (electron temperature) Ep of plasma in the case where the hollow member 20 has been filled with the Xe gas of 1 to 1000 Pa. After the supply of the electromagnetic wave to the internal space 101 of the cavity resonator 10 is started by the electromagnetic wave supply unit 3 at time T3, the standing wave energy $E_Q$ increases and reaches a predetermined value at time T4.

A time interval T between time T3 and time T4 is represented by expression (2) on the basis of the Q value of the cavity resonator 10 and an oscillation cycle $T_M$ of the electromagnetic wave supplied from the electromagnetic wave supply unit 3.

$$T=(Q/2\pi)T_M \quad (2)$$

If the Q value is 10000 and $T_M$ is 0.41 ns (frequency: 2.45 GHz), then the time T is estimated to be approximately 0.64 μs according to expression (2). This means that a standing wave having the energy $E_Q$ equal to the predetermined value is formed in an extremely short time.

The time interval T between time T3 and time T4 is substantially the same as the time interval between time T1 and time T2 (refer to FIG. 3A and FIG. 3B). This means that the time required for the standing wave energy $E_Q$ to reach the predetermined value is substantially the same for both the case where the interior of the hollow member 20 is vacuum and the case where the interior of the hollow member 20 has been filled with the Xe gas.

After the standing wave energy $E_Q$ reaches the predetermined value, the Xe gas charged inside the hollow member 20 begins to absorb the energy of the standing wave at time T5. Thus, after the time T5, plasma is produced in the hollow member 20 and an energy Ep thereof increases. Meanwhile, after the time T5, the energy $E_Q$ of the standing wave decreases. The decrease in the energy $E_Q$ of the standing wave means a decrease in the effective Q value of the cavity resonator 10, including the plasma derived from the Xe gas (more precisely, an equivalent circuit thereof).

At time T6, the energy Ep of the plasma reaches an extremely large value (or a maximum value) that is sufficiently high for the plasma to emit the EUV light. Thus, the light source device 1 emits the EUV light into the casing C, and the EUV light is irradiated to the semiconductor wafer W via the optical system M disposed in the casing C (refer to FIG. 1).

The plasma continues to absorb the standing wave energy $E_Q$ even after the time T6, but the standing wave energy $E_Q$ decreases to a level that cannot produce plasma having an electron temperature Ep that is sufficiently high to generate the EUV light. Hence, after the time T6, the standing wave energy $E_Q$ and the plasma energy Ep decrease, causing the plasma to reach an equilibrium state, so that the plasma energy Ep cannot be increased even if the supply of the electromagnetic wave to the cavity resonator 10 is continued.

According to the light source device 1 of the present invention, therefore, the supply of the electromagnetic wave to the cavity resonator 10 by the electromagnetic wave supply unit 3 is stopped at time T7 (e.g., the time at which the plasma energy $E_Q$ decreases to approximately one tenth of the maximum value). This causes the standing wave energy $E_Q$ and the plasma energy Ep to drop to zero, stopping the emitting operation of the light source device 1. Thereafter, the supply of the electromagnetic wave to the cavity resonator 10 by the electromagnetic wave supply unit 3 is resumed, thus enabling the light source device 1 to generate the EUV light again.

With this arrangement, according to the light source device 1, the EUV light is emitted intermittently or in a pulsed manner. The pulse period and the duty ratio of the EUV light emitted by the light source device 1 can be adjusted by controlling an electromagnetic wave supply period $\tau_1$ (the period from time T3 to time T7 in FIG. 3B) per supply by the electromagnetic wave supply unit 3 and an electromagnetic wave supply interruption period $\tau_2$ per interruption. For example, $\tau_1$ is controlled to 100 μs and $\tau_2$ is controlled to 150 μs to generate EUV light having a pulse period of 250 μs and a duty ratio of 0.40. Further, both $\tau_1$ and $\tau_2$ are controlled to 200 μs to generate EUV light having a pulse period of 400 μs and a duty ratio of 0.50.

(Operational Advantages of the Light Source Device)

According to the light source device 1 exhibiting the functions described above, the energy of the standing wave generated by supplying the electromagnetic wave to the internal space 101 of the cavity resonator 10 can be absorbed by the rare gas or the like existing inside the hollow member 20. Thus, the plasma derived from the rare gas or the like can be generated, and the electron temperature (the energy) $E_Q$ of the plasma can be increased to a sufficient level for emitting the EUV light (refer to time T5 to time T6 in FIG. 3B). Then, the first state in which the EUV light is emitted to the outside through the window 104 of the cavity resonator 10 can be achieved.

Meanwhile, the state changes to the equilibrium state, in which the energy absorbed by the plasma from the standing wave counterbalances with the energy released by the light emission as the electron temperature $E_Q$ of the plasma decreases with the emission of mainly visible light in addition to the EUV light (refer to time T6 and after in FIG. 3B). For this reason, the even if the supply of the electromagnetic wave to the internal space 101 of the cavity resonator 10 is continued, the first state cannot be resumed by raising the electron temperature $E_Q$ of the plasma to the level that is adequate for producing the EUV light. Even though the light is emitted from the plasma in the equilibrium state, the light has a lower energy level than the EUV light and does not contain an EUV light component.

As a solution, the second state, in which the supply of the electromagnetic wave to the internal space 101 of the cavity resonator 10 is stopped to extinguish the plasma so as to stop the emission of the extreme ultraviolet light from the plasma, is engaged (refer to time T7 and after in FIG. 3B). In other words, the light source device 1 is reset from the first state to the second state. After the resetting, the supply of the electromagnetic wave to the cavity resonator 10 is restarted, thereby resuming the first state. This enables the light source device 1 to emit the EUV light in an off-and-on manner or intermittently.

The light source device 1 uses neither a target material nor electrodes. Therefore, debris that interferes with the formation of a circuit pattern will not be produced, and a short-wavelength light component (EUV light component) best suited for forming a highly integrated circuit (miniaturized circuit) on the semiconductor wafer W can be emitted from the light, which is derived from the generated plasma, through the window 104, thereby directly or indirectly irradiating the light component to the semiconductor wafer W (refer to FIG. 1).

The light source device 1 is further provided with an adjusting mechanism configured to adjust the Q value of the cavity resonator 10 (refer to (Tuning) described above). The adjusting mechanism is constituted of the movable wall section (the covering member) 110, which is a part of the wall section that defines the internal space 101 of the cavity resonator 10 and which is configured to be movable with respect to the rest of the wall section, a driving mechanism (the tapped holes 114 and the male screws 115), which drives the movable wall section 110, and the stub tuner 32. The stub tuner 32 is adjusted to restrain as much as possible the reflection of the electromagnetic wave incident in the cavity resonator 10.

This arrangement makes it possible to adjust the length of the duration of the first state by adjusting the level of the Q value of the cavity resonator 10. Hence, the period of duration of the first state and the period of time of supplying the electromagnetic wave to the cavity resonator 10 can be matched. This permits improved efficiency of the conversion from the energy of the electromagnetic wave supplied to the cavity resonator 10 into the energy for generating the plasma required to emit the EUV light.

The tubular member constituting the hollow member 20 has one end thereof in communication with the gas supply unit 4 and the other end thereof in communication with the through hole formed as the window 104 in the bottom section 103 of the cavity resonator 10. Thus, a rare gas or the like is continuously supplied to the hollow member, preventing a rare gas or the like, the efficiency thereof for producing the plasma has deteriorated, from accumulating in the hollow member. Therefore, the plasma in an appropriate condition for efficiently emitting the EUV light can be steadily generated. The light source device 1 is capable of intermittently emitting the EUV light, which is generated in the pulsed manner, and also capable of generating the EUV light extremely promptly. This permits uniform transfer of a circuit pattern onto a semiconductor wafer W by adjusting the number of the emissions of the EUV light even when the intensity of the EUV light per pulse varies.

Other Embodiments of the Present Invention

In the embodiment described above, the shape, namely, the cylindrical shape, of the cavity resonator 10 and the dimensions thereof, including the inside diameter of the peripheral wall section 102, have been designed according to the lowest-order resonance mode, namely, TM010 mode, of the electromagnetic wave. Alternatively, however, a different mode may be adopted as the lowest-order resonance mode of the electromagnetic wave, and the cavity resonator may be designed with a different shape, such as a square tube shape, and different dimensions according to the adopted mode.

In the embodiment described above, the magnetron has been used as the electromagnetic wave supply unit 3. Alternatively, however, a Klystron may be used to supply an electromagnetic wave with higher stability to the cavity resonator 10.

In the embodiment described above, the rotary pump has been used to vacuumize the internal space of the casing C. Alternatively, however, the internal space of the casing C may be vacuumized by connecting a turbo-molecular pump in series with the rotary pump.

In the embodiment described above, the Xe gas has been used as the rare gas. Alternatively, however, an Ne gas may be used.

The electromagnetic wave supply unit 3 may alternatively be configured such that each of the length of the period during which the electromagnetic wave is supplied to the internal space 101 of the cavity resonator 10 and the length of the period during which the supply of the electromagnetic wave is stopped can be adjusted.

The light source device 1 having the configuration described above is capable of matching the period of the duration of the first state and the period of supplying the electromagnetic wave to the cavity resonator 10. This permits improved efficiency of the conversion from the energy of the electromagnetic wave supplied to the cavity resonator 10 into the energy for generating the plasma required to emit the EUV light.

What is claimed is:

1. A light source device, comprising:

a cavity resonator having a window;

a hollow member which is formed of an electrically isolating, nonmagnetic material, and which is disposed in an internal space of the cavity resonator; and an electromagnetic wave supply unit configured to form a standing wave by supplying an electromagnetic wave to the internal space of the cavity resonator, wherein the light source device is configured to repeatedly implement, in alternate shifts, a first state in which the electromagnetic wave supply unit supplies an electromagnetic wave to the internal space of the cavity resonator to cause a rare gas or a mixed gas containing a rare gas, which exists in the hollow member, to absorb energy of the standing wave thereby to generate plasma and to raise an electron temperature thereof so as to emit extreme ultraviolet light, which is emitted from the plasma, out of the cavity resonator through the window, and a second state in which the electromagnetic wave supply unit stops the supply of the electromagnetic wave to the internal space of the cavity resonator thereby to extinguish the plasma.

2. The light source device according to claim 1, further comprising:

an adjusting mechanism configured to adjust a Q value of the cavity resonator.

3. The light source device according to claim 2, wherein the adjusting mechanism comprises a movable wall section, which is a part of a wall section that defines the internal space of the cavity resonator and which is configured to be movable with respect to the rest of the wall section, and a driving mechanism, which drives the movable wall section.

4. The light source device according to claim 3, wherein the cavity resonator has a columnar internal space, the movable wall section is formed of a wall section that defines one end of the internal space, and the driving mechanism is configured to be movable in a direction of an axis line of the internal space.

5. The light source device according to claim 1, wherein the electromagnetic wave supply unit is configured to be capable of adjusting a length of a period of time during which the electromagnetic wave is supplied to the internal space of the cavity resonator and a period of time during which the supply of the electromagnetic wave is interrupted.

6. The light source device according to claim 1, wherein at least a part of the hollow member is disposed at a position where an electric field amplitude of the standing wave becomes maximum in the internal space of the cavity resonator.

7. The light source device according to claim 6, wherein the internal space of the cavity resonator is formed to have a columnar shape, and the hollow member is formed of a tubular member that extends in a direction of a central axis of the internal space of the cavity resonator.

8. The light source device according to claim 7, wherein the tubular member is disposed such that one end thereof is in communication with a supply source of the rare gas or the mixed gas while the other end thereof is in communication with a through hole formed as the window in a bottom wall section of the cavity resonator.

9. The light source device according to claim 1, wherein the rare gas is xenon (Xe) gas or a mixed gas of the xenon (Xe) gas and neon (Ne) gas.

10. The light source device according to claim 1, wherein the hollow member is formed of ceramics, silica glass or sapphire.

11. A method for generating extreme ultraviolet light, comprising:

a step for supplying a rare gas or a mixed gas containing a rare gas to a hollow member which is formed of an electrically isolating, nonmagnetic material, and which is disposed in an internal space of a cavity resonator having a window;

a first step for supplying an electromagnetic wave to the internal space of the cavity resonator to cause the rare gas or the mixed gas containing rare gas, which exists in the hollow member, to absorb the energy of a standing wave so as to generate plasma and to raise an electron temperature thereof, and for emitting extreme ultraviolet light that is emitted from the plasma to the outside of the cavity resonator through the window; and a second step for interrupting the supply of the electromagnetic wave to the internal space of the cavity resonator to extinguish the plasma thereby to interrupt the emission of the extreme ultraviolet light, wherein the first step and the second step are alternately repeated.

* * * * *

UNITED STATES PATENT AND TRADEMARK OFFICE

CERTIFICATE OF CORRECTION

PATENT NO. : 8,698,115 B1
APPLICATION NO. : 13/851349
DATED : April 15, 2014
INVENTOR(S) : Masami Onishi and Waheed Hugrass It is certified that error appears in the above-identified patent and that said Letters Patent is hereby corrected as shown below:

Title Page, item 72:

Inventor:

Change "Masashi Onishi" to --Masami Onishi--

Signed and Sealed this
Seventeenth Day of March, 2015

Michelle K. Lee

Michelle K. Lee
*Director of the United States Patent and Trademark Office*